US006126421A

United States Patent [19]

Matsumoto et al.

[11] Patent Number: 6,126,421

[45] Date of Patent: Oct. 3, 2000

[54] SCROLL TYPE COMPRESSOR IN WHICH A SEALING IS IMPROVED BETWEEN SCROLL MEMBERS

[75] Inventors: Takayuki Matsumoto, Isesaki; Saori Shimizu, Takasaki, both of Japan

[73] Assignee: Sanden Corporation, Gunma, Japan

[21] Appl. No.: 09/329,797

[22] Filed: Jun. 10, 1999

[30] Foreign Application Priority Data

Jun. 18, 1998 [JP] Japan ..... 10-171178

[51] Int. Cl.[7] ..... F01C 1/02

[52] U.S. Cl. ..... 418/55.2; 418/178

[58] Field of Search ..... 418/55.2, 178

[56] References Cited

U.S. PATENT DOCUMENTS 4,645,436 2/1987 Sakamoto ..... 418/55.2

FOREIGN PATENT DOCUMENTS 0743454 11/1996 European Pat. Off. .
0816684 1/1998 European Pat. Off. .
0069788 3/1989 Japan ..... 418/55.2
1147181 6/1989 Japan .
406026475 2/1994 Japan ..... 418/55.2

*Primary Examiner*—Thomas Denion
*Assistant Examiner*—Theresa Trieu
*Attorney, Agent, or Firm*—Baker Botts L.L.P.

[57] ABSTRACT

In a scroll type compressor in which bottom plates (2, 3) are disposed on bottoms of involute grooves formed on scroll members (20, 30), respectively, each of the bottom plates has a thickness becoming gradually larger from an outer circumferential portion of each of the involute grooves towards a central portion thereof. The scroll members confront with each other in an axial direction with each of the bottom plates being interposed between the scroll members in the axial direction.

4 Claims, 3 Drawing Sheets

SCROLL TYPE COMPRESSOR IN WHICH A SEALING IS IMPROVED BETWEEN SCROLL MEMBERS

BACKGROUND OF THE INVENTION

The present invention relates in general to a scroll type compressor and more particularly to a scroll type compressor having bottom plates disposed at bottom portions of confronting scroll members.

With reference to FIG. 1, description will be made as regards a conventional scroll type compressor designated by a reference numeral 50. The scroll type compressor 50 comprises a casing 11 and, in the casing 11, a movable scroll member 20 and a fixed scroll member 30 which have involute members 21 and 31 and end plates 22 and 32 integral with the involute members 21 and 31, respectively. In other words, the movable and the fixed scroll members 20 and 30 have involute grooves which are defined by the involute members 21 and 31 and end plates 22 and 32, respectively. The movable and the fixed scroll members 20 and 30 are engaged with each other in a confronting relation with their involute curves offset at 180 angular degrees with each other. As a result, a plurality of compression spaces are defined between the movable and the fixed scroll members 20 and 30.

The fixed scroll member 30 is fixed in the casing 11. The movable scroll member 20 is unrotationally but orbitally movably supported, in a front housing 14, on the side opposite to the side of the involute member 21 of the end plate 22 through a rotation-preventive mechanism 15. So that, the movable scroll member 20 provides an orbital motion along its orbital way. A boss portion 23 in the form of projection is disposed nearer to the central portion of the end plate 22 of the movable scroll member 20. An eccentric bush 17 of the driving mechanism is disposed through a drive bearing 18 to permit a orbital motion of the movable scroll member 20.

The driving mechanism comprises an enlarged portion 40*b* disposed at an end of the driving shaft 40*a*, an eccentric pin 40*c* disposed on the opposite side of the driving shaft 40*a* of the enlarged portion 40*b*, and an eccentric bush 17 for permitting the eccentric pin 40*c* to extend through the eccentric portion. The boss portion 23 serves to rotatably support the eccentric bush 17 through the drive bearing 18.

When the movable scroll member 20 is orbitally moved, a fluid is sucked in each compression space and is compressed by the revolution-preventive, orbital motion of the movable scroll member 20 relative to the fixed scroll member 30 with movement to a central portion of the involute members 21, 31. Thereafter, the fluid is discharged from the discharge hole 33 disposed at a center of the end plate 32 into a discharge chamber 39.

In the scroll compressor 50, a drive bearing 18 is press-fitted to the central portion of the end plate 22 of the movable scroll member 20. It is assumed that this press-fitting of the drive bearing 18 causes the movable scroll member 20 to generate bending or warping which corresponds to the press-fitting force. The bending or warping produces a gap between each of the involute members 21 and 31 and each of the end plates 22 and 32. The gap is increased at a central portion than at the other outer circumferential portions. Therefore, a sealing effect to each compression space decreases at the central portion of each of the scroll members 20, 30 to result in reduction of a discharging capacity and generation of noises due to blow-by gas of the fluid.

An attempt was made to provide tip seals 51 and 61 having a larger thickness at the central portions thereof than the other portions. But, it is found that if the thickness of the central portions is larger than required, it permits the fluid to accidentally flow along the side surface of the tip seals 51 and 61 to generate blow-by, resulting in reduction of discharge capacity.

SUMMARY OF THE INVENTION

It is an object of the present invention to provide a scroll type compressor in which a sealing is improved between scroll members confronting with each other to define a compression space therebetween.

It is another object of the present invention to provide a scroll type compressor in which any generation of bow-by is prevented between the scroll members to thereby provide a high efficiency and performance with less noise.

Other objects of the present invention will become clear as the description proceeds.

A scroll type compressor to which the present invention is applicable comprises a pair of scroll members having involute grooves, respectively, and a pair of bottom plates disposed on bottoms of the involute grooves, respectively. The scroll members confront with each other in an axial direction with each of the bottom plates being interposed between the scroll members in the axial direction. In the scroll type compressor, each of the bottom plates has a thickness becoming gradually larger from an outer circumferential portion of each of the involute grooves towards a central portion thereof.

DESCRIPTION OF THE PREFERRED EMBODIMENT

Figure 2:
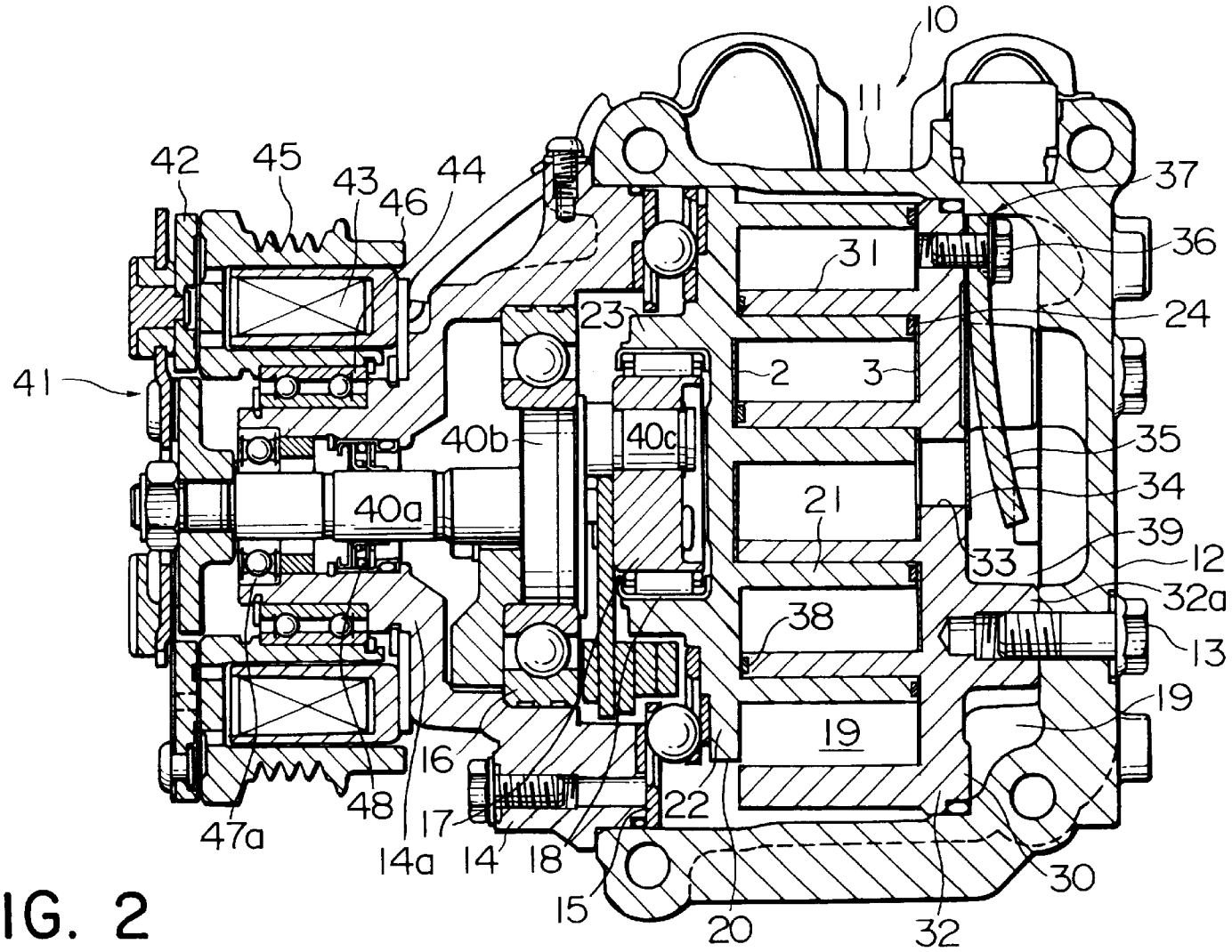
FIG. 2 is a sectional view of a scroll type compressor according to an embodiment of the invention.

With reference to FIG. 2, the description will be made as regards a scroll type compressor according to an embodiment of the invention. Similar parts are designated by like reference numerals.

The scroll type compressor is designated by a reference numeral 10. In the scroll type compressor 10, the fixed scroll member 30 has the involute member 31 having the involute curve and the end plate 32 fixed to one side of the involute member 31 in an axial direction. In other words, the fixed scroll member 30 has an involute groove defined by the involute member 31 and the end plate 32 to extend along the involute curve. The end plate 32 has at its central portion a discharge hole 33 for discharging a compressed fluid. At the opening portion of the discharge hole 33 is provided a discharge mechanism 37 which has a discharge valve 34, a valve holder 35, and a bolt 36 fixing the valve elements 34 and 35.

The fixed scroll member 30 is fixed, at a projection portion 32*a*, to a bottom portion 12 of the casing 11 by a bolt 13, and confines a discharge chamber 39 and a suction chamber 19 between the end plate 32 and the bottom portion 12 of the casing 11. A tip seal 38 is provided at a tip portion of the involute member 31.

The movable scroll member 20 has an involute member having a wall portion of an involute curve similar with the involute member 31 of the fixed scroll member 30, and an end plate 22 fixed to one end of the involute member 21. In other words, the movable scroll member 20 has an involute groove defined by the involute member 21 and the end plate 22 to extend along the involute curve. The involute member 21 is engaged with the other involute member 31 with its involute curve being offset by 180° relative to the involute curve of the involute member 31. As a result, a plurality of compression spaces are defined between the movable and the fixed scroll members 20 and 30.

Figure 1:
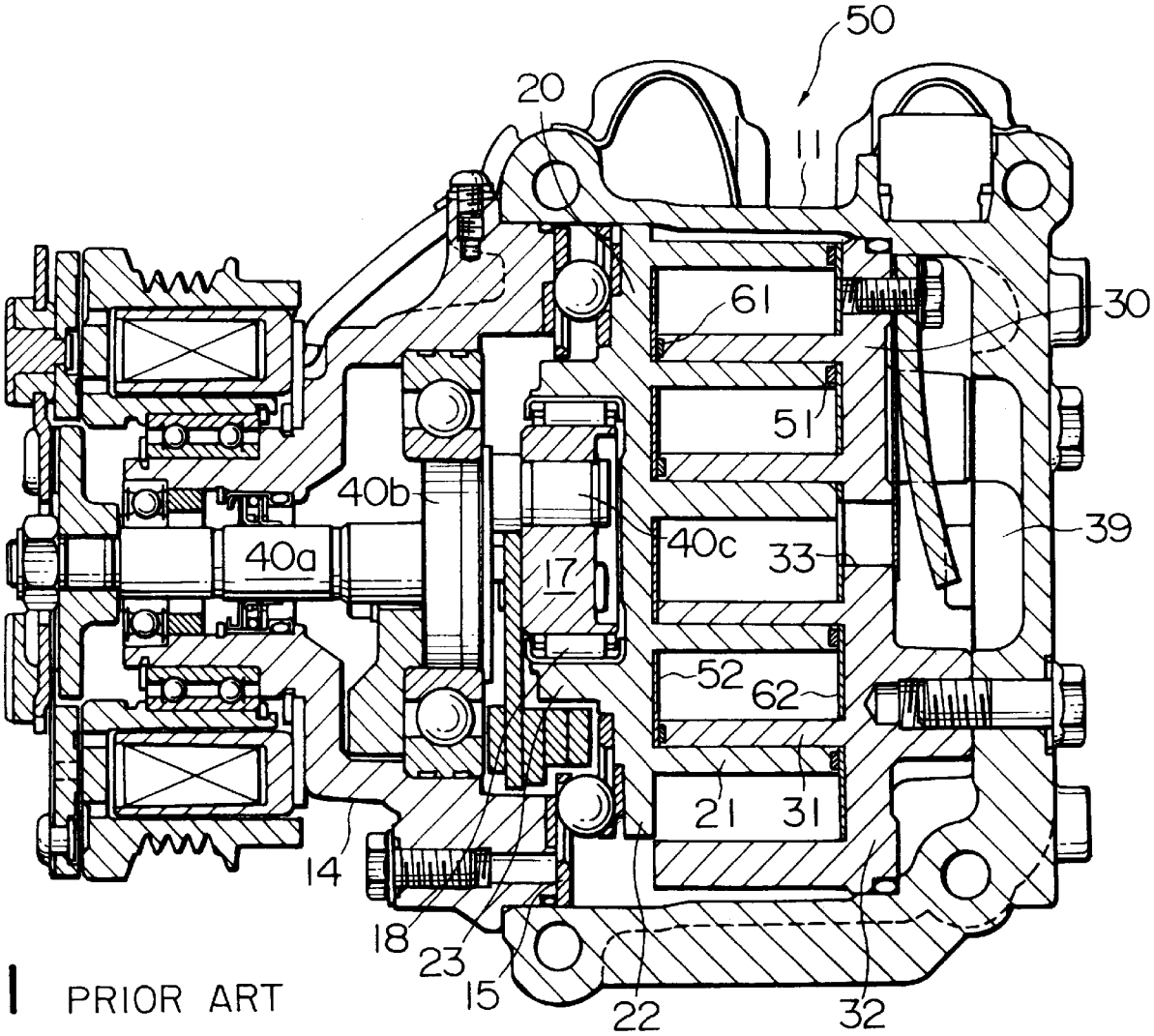
FIG. 1 PRIOR ART
FIG. 1 is a sectional view of a conventional scroll type compressor.

On an opposite side of the end plate 22, relative to the side to which the involute member 21 is fixed, is provided a boss portion 23 cylindrically extending to a central portion as illustrated in FIG. 1. A rotation prevention mechanism 15 is provided on the circumferential portion of the boss portion 23 of the end plate 22 for the purpose of prevent a rotation of the movable scroll member. Thus, the movable scroll member 20 is orbitally movably, but unrotationally by the rotation prevention mechanism 15, supported to a front housing 14. The involute member 21 has a recess at a tip portion thereof and a tip seal 24 in the recess as illustrated.

The front-housing 14 has a projecting portion 14*a* which project at its central portion in a cylindrical manner, and a driving shaft 40*a* is disposed extending through the projecting portion 14*a*. The driving shaft 40*a* projects outwardly at its one end from the front housing 14, and is provided at its extended end with a clutch plate 42 of an electromagnetic clutch. A rotor 46 of the electromagnetic clutch 41 is provided through a bearing 44 at a circumferential portion of the projecting portion 14*a* of the front housing 14. In the rotor 46 is disposed an electromagnetic device 43 so that the clutch plate 42 is forcibly attracted to the rotor 46 to deliver a torque of the rotor 46 to the driving shaft 40*a* through the clutch plate 42. Further, on the outer circumferential portion of the rotor, a V-groove 45 is provided for receiving a belt which serves to deliver a torque from an outer driving source (not shown).

The driving shaft 40*a* has at its other end a large diameter portion 40*b* which is rotatably supported by a shaft bearing 16. On the opposite side of the large diameter portion 40*b* of the driving shaft 40*a*, an eccentric pin 40*c* is eccentrically projected in an axial direction and inserted into an eccentric bush 17. The eccentric bush 17 is supported at its circumferential portion to an inner surface of the boss portion 23 through a drive bearing 18. The driving shaft 40*a* is supported to the front housing 14 through a bearing 47*a*. Further, a seal member 48 is provided around the driving shaft 40*a* to establish a desired sealing to an interior of the scroll type compressor 10 relative to the exterior thereof.

The scroll type compressor has an operation in which the rotor 46 is rotated by an external driving source (not shown) to deliver its torque to the clutch plate 42 which is attracted to toward the rotor by the electromagnetic device 43 to thereby rotate the driving shaft 40*a*. The rotational movement of the driving shaft 40*a* is converted into an orbital motion of the eccentric bush 17 by way of the crank pin 40*c* which is disposed to the large diameter portion 40*b* of the driving shaft 40*a*. The above-mentioned orbital motion is then converted into an orbital motion of the movable scroll member 20, which is unrotational, is by way of the driving bearing 18.

The orbital motion of the movable scroll member 20 relative to the fixed scroll member 30 sucks the fluid into the compression chambers from the circumferential portion of the involute members 21 and 31 from the suction chamber 19. The fluid is gradually compressed in the compression chambers while it is fed through the wall portions of the involute members 21 and 31 toward the central portion, along with the compression spaces. Then, the gradually compressed fluid is fed through the discharge hole 33 of the end plate 32 from the center portion of the involute member 31 to the discharge chamber 39 and then discharged out of the discharge port.

The structure of the scroll type compressor 10 is substantially similar with that of the conventional scroll type compressor 50 of FIG. 1.

Figure 3:
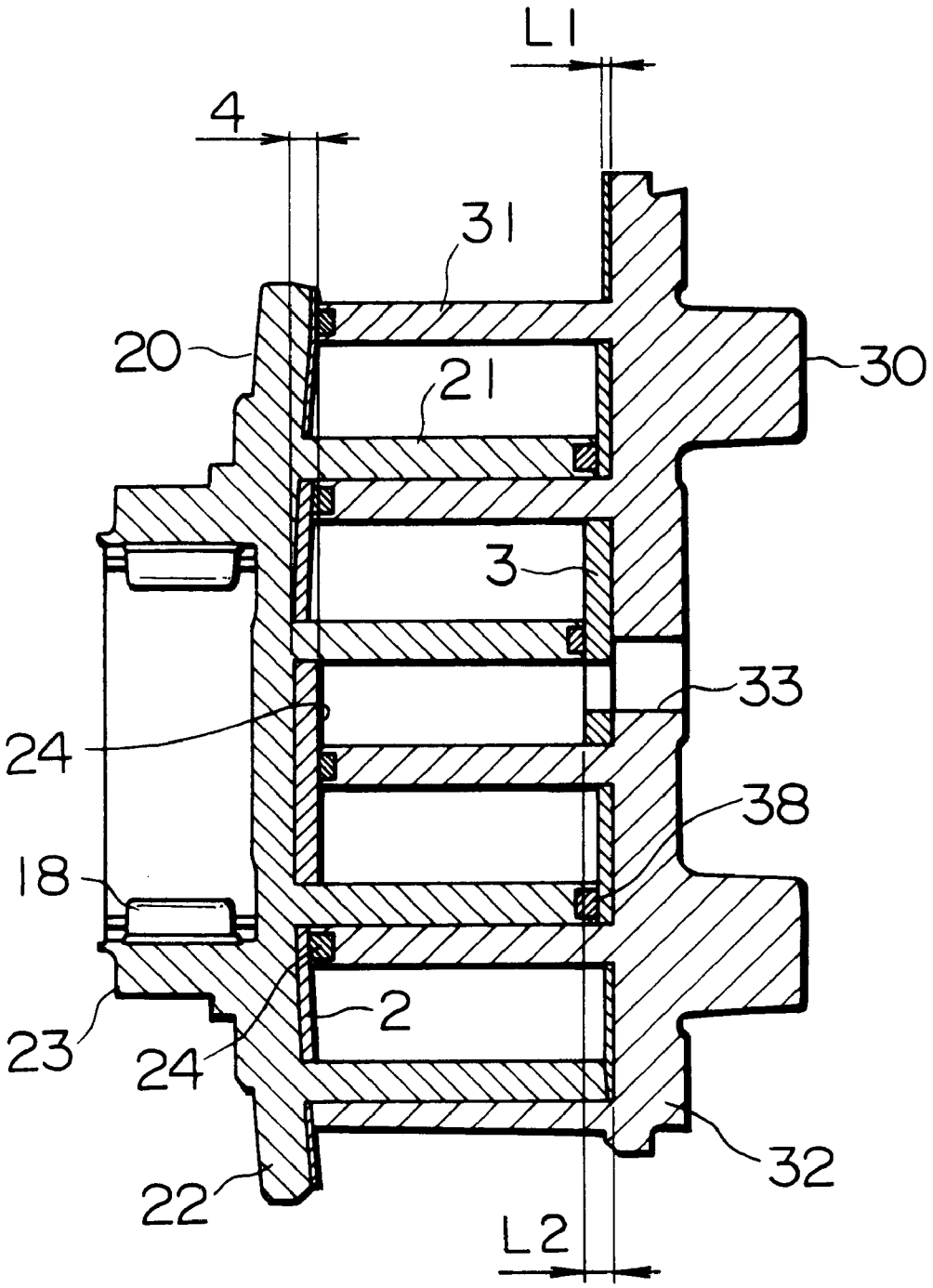
FIG. 3 is a sectional view of a movable scroll member and a fixed scroll member included in the scroll type compressor of FIG. 2.

With reference to FIG. 3 in addition, the description will be directed to a new feature in structure of the scroll type compressor 10.

Referring to FIG. 3, bottom plates 2, 3 are disposed on the bottoms of the involute grooves, respectively, that are defined by the involute members 21 and 31 and the end plates 22 and 32. More particularly, the fixed and the movable scroll members 20 and 30 confront with each other in the axial direction with each of the bottom plates 2 and 3 being interposed between the fixed and the movable scroll members 20 and 30 in the axial direction.

Each of the bottom plates 2 and 3 has a spiral shape and has a thickness which is gradually increasing from the circumferential portion of each of the involute grooves towards the central portion thereof. The gradually increasing thickness is performed by applying a resin coating on one surface of a spiral flat plate which is formed of a single body and has a uniformized thickness. In this event, the resin coating is applied to have a relatively small thickness at the outer circumferential portion of each of the involute grooves and a relatively great thickness at the central portion thereof.

By a press-fitting of the drive bearing 18 into the boss portion 23, it is assumed that the surface in which the end plate 22 of the movable scroll member 20 is in a confronting relation with the end plate 32 of the fixed scroll member 30 is forcibly distorted to become recessed or depressed so that a gap 4 is formed at the central portion and, at the same time, additional gap is formed between the end plate 32 of the fixed scroll member 30 and an extended end of the involute member 21. The gap 4 is represented by g1 at the outer circumferential portion and g2 at the central portion, and has a relation which is represented by g2>g1.

By contrast, with respect to each of the bottom plates 2 and 3, the resin coating has a first thickness L1 at the circumferential portion and a second thickness L2 at the central portion, in response to the gaps g1 and g2. Here, it is to be noted the relation between the first and the second thickness L1 and L2 is set to be as L2>L1.

A gas is taken and confined as a sucked gas in the suction chamber 19 or the compression spaces defined between the movable scroll member 20 and the fixed scroll member 30. When the movable scroll member 30 is orbitally moved, the sucked gas is moved from the outer circumferential portion of the scroll members towards the central portion thereof with being compressed in the compression spaces. At this moment, by the press-insertion of the drive bearing, a deflection or bending is generated to the movable scroll member 20 in accordance with a scale of the compression. This is the reason why an axial gap relative to the fixed scroll member 30 is formed larger at the central portion. Thus, provision of the bottom plates 2 and 3 serves to correct or compensate the axial gap. For this purpose, the bottom plates 2 and 3 are formed to have a shape to satisfactorily provide the correction of the axial gap as described.

By the thus formed bottom plates 2 and 3, improved sealing characteristics can be obtained as well as establishment of a high performance and prevention of blow-by. In addition, any reduction of discharge capacity, which is likely generated at the stroke of compression by the movable and fixed scroll members, can be prevented to thereby provide an improved scroll type compressor having a high performance and a low noise.

While the present invention has thus far been described in connection with a few embodiments thereof, it will readily be possible for those skilled in the art to put this invention into practice in various other manners. For example, each of the bottom plate may be formed of a plurality of planar leaves adhered to each other so that the thickness of the bottom plates is increased, not smoothly gradually but in a step-by-step mode, toward the central portion.

What is claimed is:

1. A scroll type compressor comprising a pair of scroll members having involute grooves, respectively, and a pair of bottom plates disposed on bottoms of said involute grooves, respectively, said scroll members confronting with each other in an axial direction with each of said bottom plates being interposed between said scroll members in said axial direction, wherein each of said bottom plates has a thickness becoming gradually larger from an outer circumferential portion of each of said involute grooves towards a central portion thereof.

2. A scroll type compressor as claimed in claim 1, wherein each of said bottom plates comprises a flat plate having a uniformized thickness and a coating provided on at least one surface of said flat plate, said coating having a relatively small thickness at said outer circumferential portion and a relatively great thickness at said central portion.

3. A scroll type compressor as claimed in claim 1, wherein each of said bottom plates is formed of a single body.

4. A scroll type compressor as claimed in claim 1, wherein each of said bottom plate is formed of a plurality of planar leaves adhered to each other.

* * * * *